US006461175B2

(12) United States Patent
Okamoto

(10) Patent No.: US 6,461,175 B2
(45) Date of Patent: Oct. 8, 2002

(54) IC CARD CONNECTOR WITH GROUNDING TERMINAL MEMBER

(75) Inventor: Taiji Okamoto, Miyagi-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/939,456

(22) Filed: Aug. 24, 2001

(65) Prior Publication Data

US 2002/0025701 A1 Feb. 28, 2002

(30) Foreign Application Priority Data

Aug. 31, 2000 (JP) ..... 2000-268410

(51) Int. Cl.[7] ..... H01R 13/648; H01R 4/66; H01R 13/40; H01R 9/16

(52) U.S. Cl. ..... 439/92; 439/733.1; 439/869

(58) Field of Search ..... 439/92, 79, 64, 439/733.1, 869, 80, 159, 95, 108

(56) References Cited

U.S. PATENT DOCUMENTS 5,108,312 A * 4/1992 Sampson ..... 439/567
5,267,125 A * 11/1993 Liu ..... 174/51
5,340,321 A * 8/1994 Hashiguchi et al. ..... 439/108
5,573,411 A * 11/1996 Bartosz et al. ..... 439/108
5,738,532 A 4/1998 Takano et al. ..... 439/79
5,749,741 A * 5/1998 Bellas et al. ..... 361/718
5,795,190 A * 8/1998 Ono ..... 439/159
RE35,896 E * 9/1998 Brunker et al. ..... 439/108
5,833,480 A * 11/1998 Austin ..... 24/295
6,042,397 A * 3/2000 Kusuhara ..... 439/101
6,162,069 A * 12/2000 Choy ..... 439/92
6,162,074 A * 12/2000 Abe et al. ..... 439/152
6,186,801 B1 * 2/2001 Kakinoki ..... 361/737

* cited by examiner

*Primary Examiner*—P. Austin Bradley
*Assistant Examiner*—Edwin A. León
(74) *Attorney, Agent, or Firm*—Beyer, Weaver & Thomas, LLP

(57) ABSTRACT

An IC card connector is provided with grounding terminal members, in which a pair of grounding terminal members has simple structure and common shape allowing a reduced cost and easy fabrication. The IC card connector is provided with a housing with a plurality of pin terminals, a frame mounted on the housing, a pair of guide sections are provided longitudinally at both side sections of the frame to remove and insert to IC card, and respective arm sections of grounding pieces. mounted on the guide sections. The IC card is inserted between the guide sections so that a grounding terminal of one side section of the IC card is made to come into contact with first expanded sections, while a grounding terminal of the other side section of the IC card is made to come into contact with second expanded sections.

4 Claims, 12 Drawing Sheets

FIG. 10A
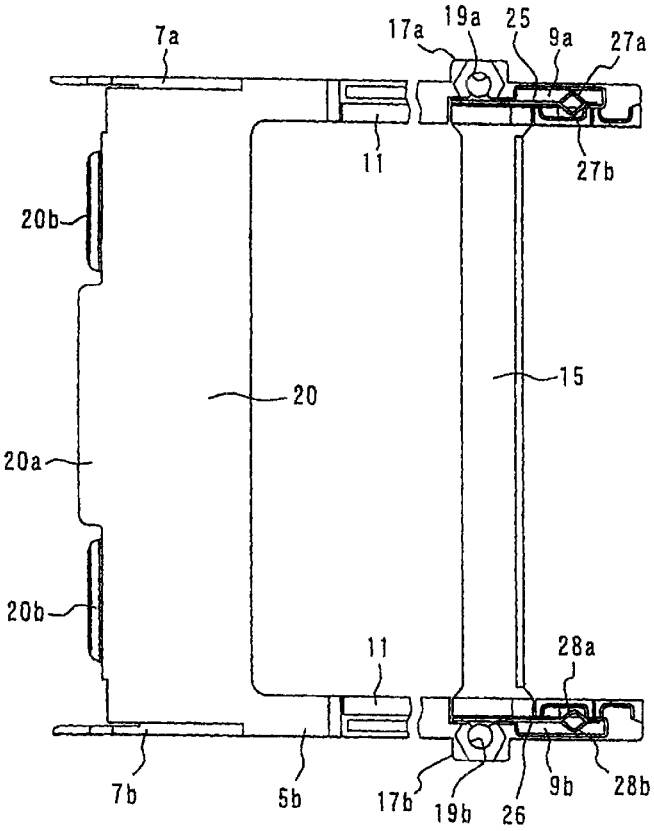
FIG. 10C
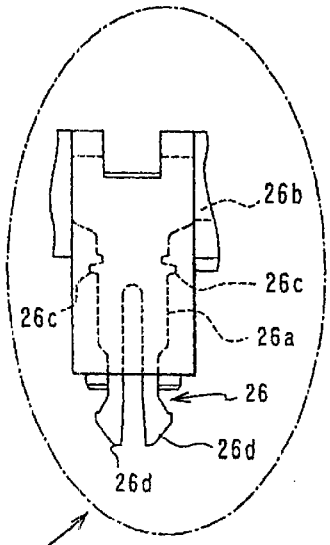
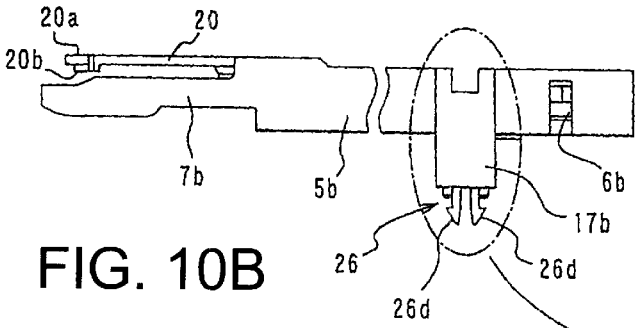
FIG. 10B

IC CARD CONNECTOR WITH GROUNDING TERMINAL MEMBER

BACKGROUND OF THE INVENTION

1. Field of the Invention

The present invention relates to an IC (Integrated Circuit) card connector used for insertion and removal of the IC card, and more particularly to an IC card connector to which countermeasures to prevent static electricity is taken and where a grounding terminal member is used for this IC card connector.

2. Description of the Related Art

The make up of a conventional IC card connector is described based on FIG.'s 13 and 14. U-shaped housing 121 made up of a molding of synthetic resin has a base section 121*a* and a guide section 121*b* extending toward the front direction from both side sections of the base section 121*a*. Further, a plurality of metallic pin terminals 122 are mounted in such a way that respective contact sections thereof are in the rear (right side of FIG. 13) and respective terminal sections 122*a* thereof are in the front, and the pin terminals 122 are buried in the base section 121*a* of the housing 121 in a parallel arrangement in the lateral direction. Furthermore, a pair of mounting member 123 made of metallic piece is mounted on both side sections in front of the housing 121.

As illustrated in FIG. 14, a shielding plate 124 made of metallic plate has a top surface plate 124*a*, a plurality of bent tongue shaped pieces 124*b* provided at the top surface plate 124*a*, C-shaped mounting sections 124*c* provided at both side sections of the top surface plate 124*a*. Further, the shielding plate 124 is combined with the housing 121 while allowing the mounting section 124*c* to be fitted to a peripheral surface of the guide section 121*b* in such a way as to cover a top surface of the base section 121*a* of the housing 121 by use of the top surface plate 124*a*, so that the top surface of the housing 121 becomes electrically shielded by the shielding plate 124.

A pair of guide members 125 made up of the molding of the synthetic resin have a guide section 125*a* that has C-shape cross section and a mounting section 125*b* extending in forward direction. The pair of guide member 125 is integrated with the housing 121 in such a way as to recess the mounting section 125*b* into the guide section 121*b* of the housing 121.

Further, a pair of contact pieces 126*a*, 126*b* made of metal plate are bent in opposite direction with each other and top sections thereof become contact sections. Furthermore, parts of the pair of contact pieces 126*a*, 126*b* extend in perpendicular direction to come into contact with circuit substrate described later.

Moreover, the pair of the contact pieces 126*a*, 126*b* are mounted on the pair of guide members 125, and parts of the contact pieces are exposed from opening sections which are not illustrated formed at the guide section 125*a* to come into contact electrically with an IC card, which is inserted, described later.

Then, the IC card connector having such a constitution is incorporated into an electronic apparatus to be used, and its incorporation is performed in such a way that terminal section 122*a* of the pin terminal 122 is connected to conductive pattern 128 provided on the circuit substrate 127, and one pair of mounting members 123 are mounted on the conductive pattern 128 with the mounting member 123 soldered. Further, a rectangular shaped IC card 30 used for such electronic apparatus is provided with a contact section capable of being connected to the pin terminal 122 at front section thereof and is provided with one pair of grounding terminals 31 at both side sections thereof.

Although the IC card 30 is used in such a way as to be inserted into or removed from the IC card connector, the IC card 30 is invariably inserted into the IC card connector using the guide section 125*a* of the guide member 125 as a guide. Further, when advancing the insertion of the IC card 30, a pointed end section thereof is inserted using the guide section 121*b* of the housing 121 as a guide. The insertion is completed when the contact section of the IC card 30 comes into contact with the pin terminal 122.

Furthermore, when the IC card 30 is completely inserted, the grounding terminal 31 of the IC card 30 comes into contact with the contact pieces 126*a*, 126*b*, while the IC card 30 simultaneously becomes elastically supported by the bent tongue shaped piece 124*b*. Further, the IC card 30 is capable of being pulled out from the IC card connector by hand, with the housing 121 and the guide member 125 as the guides are.

Now, since the pair of contact pieces 126*a*, 126*b* are shape differently from each other, dies for manufacturing each contact piece is prepared separately. The contact pieces 126*a*, 126*b* are made by undergo presswork utilizing each different die.

Thus, since it is necessary to prepare two kinds of dies in compliance with the contact pieces 126*a*, 126*b*, there is the problem of the time and the expense are required for manufacturing the dies.

Furthermore, the contact pieces 126*a*, 126*b* are small parts, accordingly, it is necessary to assemble the contact pieces 126*a*, 126*b* into the guide sections 125*a*, 125*a* by hands, for that reason, there is a possibility that the contact pieces 126*a*, 126*b* may be accidentally mounted on the opposite end of the guide sections 125*a*, 125*a*.

Moreover, when the pair of contact pieces 126*a*, 126*b* are mounted on the guide sections 125*a*, 125*a* respectively, subsequently, it was necessary to use a jig when the connector is made to fix the connector on the circuit substrate 127 by use of the screws and so forth which are not illustrated.

SUMMARY OF THE INVENTION

In view of the foregoing it is an object of the present invention to provide an IC card connector provided with grounding terminal members where a right side grounding terminal member and left side grounding terminal member are formed to have a simple structure and common shape, to reduce cost and allow easier assembly.

As a first solution for solving at least one of the aforementioned problems, there is provided a grounding terminal member while blanking a metal plate that is provided integrally with a leg section, a flat board shaped arm section, and first and second expanded sections being expanded outward at inside and outside of the arm section, wherein the leg section is made to ground, and any one of the first and the second expanded sections is made to elastically come into contact with a grounding terminal of electronic components.

As a second solution, there is provided an IC card connector that uses the grounding terminal member described in the first solution, comprising a housing on which a plurality of pin terminals are mounted and a frame which is mounted on the housing, wherein a pair of guide sections which are used at the time that the IC card is inserted and removed are provided longitudinally at both side sections of the frame, and the arm section of the grounding terminal member is mounted on the respective guide sections. The IC card is made to insert between the respective guide sections, and a grounding terminal of one side section of the IC card is made to come into contact with the first expanded section, while a grounding terminal of opposite side section to the one side section is made to come into contact with the second expanded section.

As a third solution, there is provided an IC card connector, in the second solution, wherein the housing is made to mount on a circuit substrate, subsequently, allowing pointed end of the leg section of the grounding terminal member to be projected from the guide section to establish continuity between the pointed end and a grounded pattern of the circuit substrate.

As a fourth solution, there is provided an IC card connector, in the second solution, wherein supporting leg sections are provided at both side sections of the frame, and pointed ends of the supporting leg sections are placed on the surface of the circuit substrate, thus allowing the pointed end of the leg sections of the grounding terminal member to be projected from the supporting leg sections.

As a fifth solution, there is provided an IC card connector, in the second solution, wherein engaging claws are formed at pointed ends of the leg sections, and the engaging claws are made to insert into hole sections of the circuit substrate to engage the guide section to the circuit substrate.

BRIEF DESCRIPTION OF THE DRAWINGS

FIG. 10 is a principal portion enlarged view of the grounding terminal member of the IC card connector to be one embodiment of the present invention;

DESCRIPTION OF THE PREFERRED EMBODIMENTS

Hereinafter an embodiment of an IC card connector of the present invention will be explained on the basis of FIG. 1 to FIG. 12.

Figure 4:
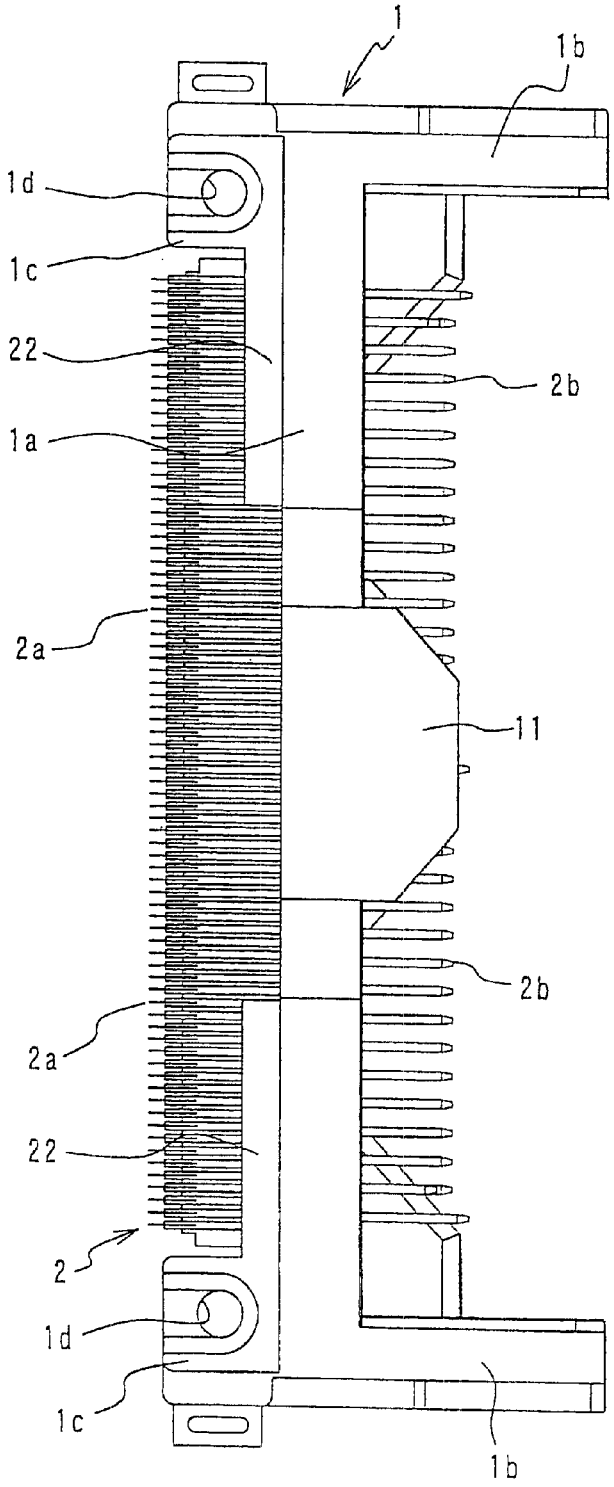
FIG. 4 is a plan view of a housing of the IC card connector to be an embodiment of the present invention.
Figure 5:
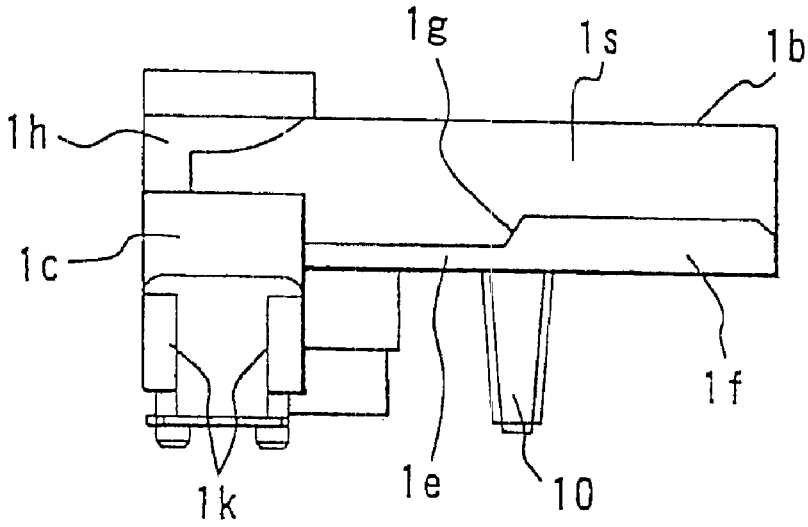
FIG. 5 is a side view of the aforementioned housing.
Figure 6:
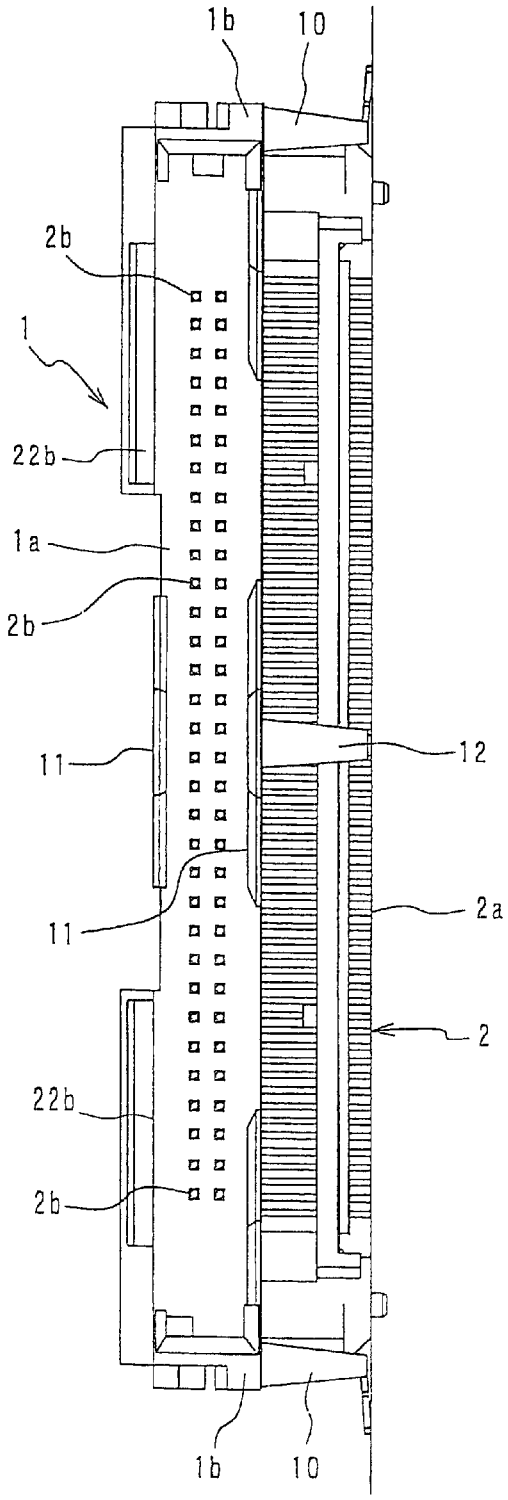
FIG. 6 is a rear view of the aforementioned housing.

As illustrated in FIG. 4 to FIG. 6, an approximately U-shaped housing 1 made up of the molding of synthetic resin has a base section 1*a* mounted with a plurality of pin terminals 2, a pair of arm sections 1*b* extending in the rear (right side in FIG. 4) from both ends of the base section 1*a*, and leg section 1*c* projected forward slightly from both ends of the base section 1*a* and projected downwards. Further, at the leg section 1*c*, mounting hole 1*d* for mounting a screw and so forth is formed.

As illustrated in FIG. 5, at outside surface of the arm section 1*b*, first and second long thin projection sections 1*e*, 1*f* are formed to be projected integrally with the arm section 1*b* along with longitudinal direction thereof and at a connection section between the first long thin projection section 1*e* and the second long thin projection section 1*f*, a step section 1*g* is formed.

Right-angled struck section 1*h* is formed protrusively at upper portion of both side sections of the above-described leg section 1*c*, and at lower portion thereof, engaging claw sections 1*k* for mounting flat plate shaped metal terminal 4 (referring to FIG. 1) are formed.

Further, at the both side sections of the housing 1, each engaging groove 1*s* which is enclosed by the aforementioned first and second long thin projection sections 1*e*, 1*f* and right-angled struck section 1*h* so as to form one flat surface is constituted.

Furthermore, at the center of underside of the arm section 1*b*, respective first supporting leg sections 10 are provided, and a pair of opposite trapezoidal shaped trapezoidal plates 11 are provided protrusively in the rear at approximately the center of the base section 1*a*. A second supporting leg section 12 is provided downward from the under side trapezoidal plate. Thus, a fixed distance from the circuit substrate, described later, depends on the first and the second supporting leg sections 10, 12, and the leg section 1*c*.

The pin terminal 2 made of metallic material has a terminal section 2*a* that is bent in the crank shape and a contact section 2*b* whose cross section is rectangular shape. As illustrated in FIG. 4, a plurality of pin terminals 2 are mounted on the housing 1 while being buried in the housing 1 in such a way as to be buried in the longitudinal direction of the base section 1*a* of the housing 1 in the condition that the terminal sections 2*a* are in the front (left hand side of FIG. 4) and the contact sections 2*b* are in the rear (right hand side of FIG. 4).

As illustrated in FIG. 6, at upper side section of front side of the base section 1*a*, small rectangular shaped contact portions 22, 22 are provided integrally with the base section 1*a* and part of the leg section 1*c*. Rectangular shaped grooves 22*b*, 22*b* are formed at the aforementioned contact portions 22, 22 so that the rectangular grooves 22*b*, 22*b* becomes parallel with contact section 2*b* of the pin terminal 2 toward upper surface of the base section 1*a* in the rear side of the contact portions.

Figure 1:
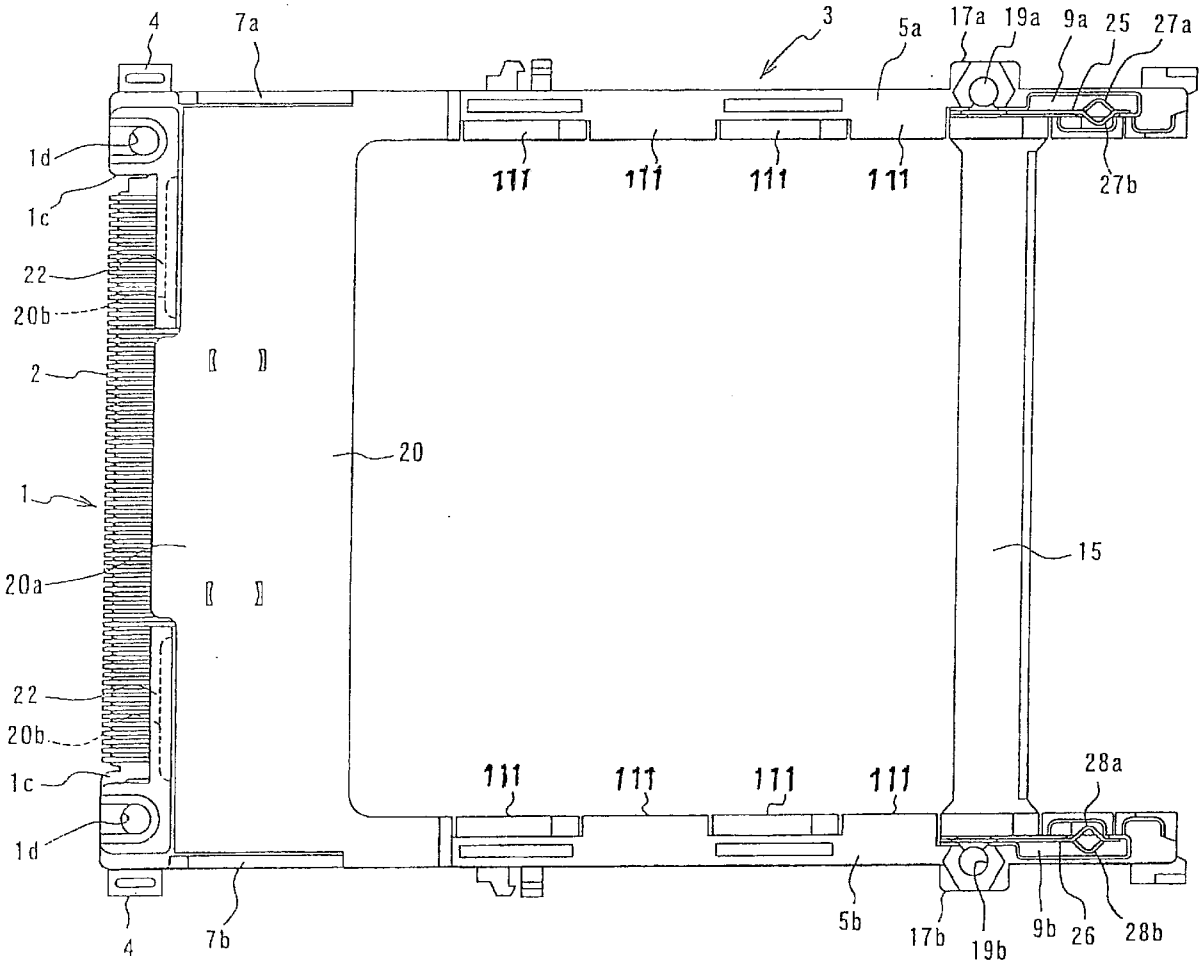
FIG. 1 is a plan view of an IC card connector to be an embodiment of the present invention.
Figure 2:
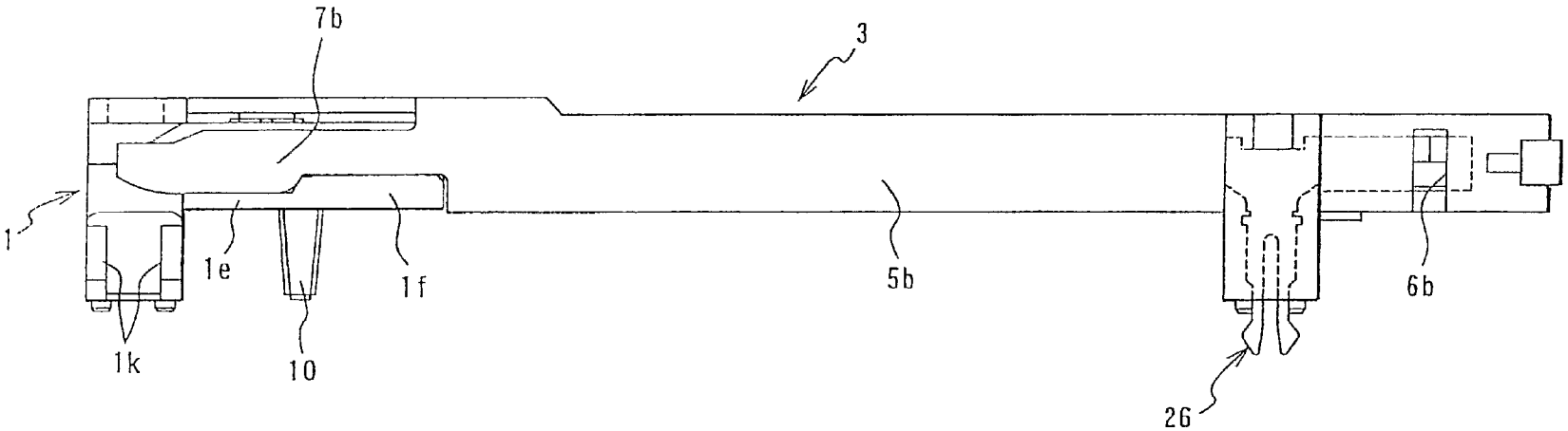
FIG. 2 is a side view of an IC connector to be an embodiment of the present invention.
Figure 3:
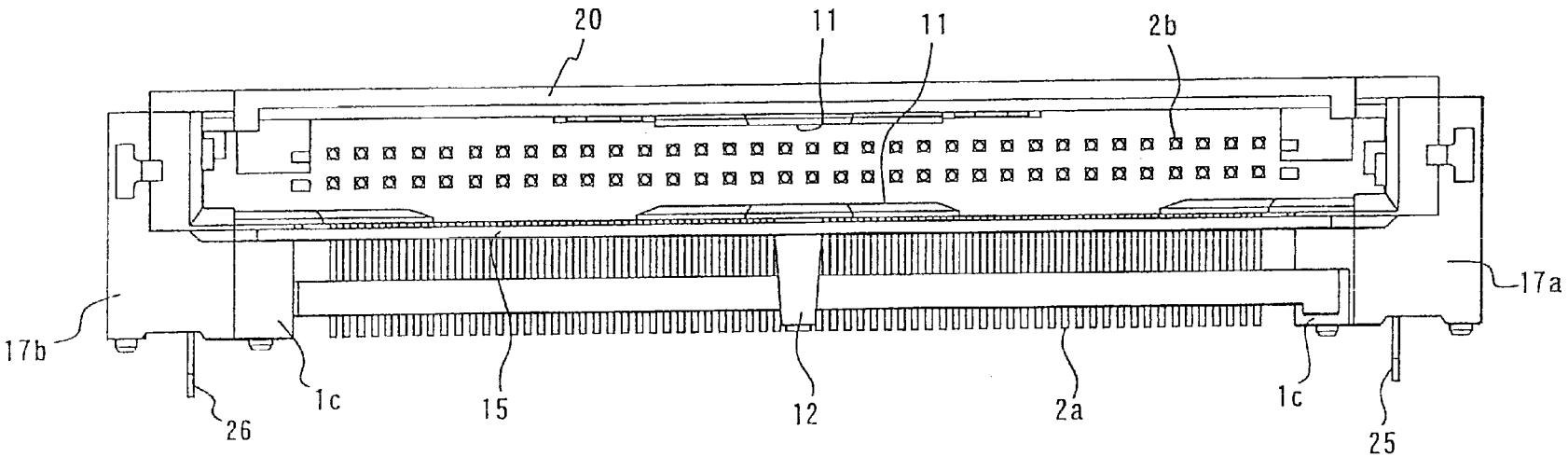
FIG. 3 is a rear view of an IC card connector to be an embodiment of the present invention.

Next, as illustrated in FIG. 1 to FIG. 3, a rectangular shaped piece of frame 3 made of synthetic resin has a pair of rectangular shaped guide sections 5*a*, 5*b* that are arranged at both side sections thereof and oppositely with each other. Engaging pieces 7*a*, 7*b* extend to provide pointed ends to the front side of the guide sections 5*a*, 5*b*. Long narrow engaging grooves 9*a*, 9*b* are formed in such a way as to be chipped perpendicularly (up-and-down direction of FIG. 2) to the board thickness in the rear side.

As illustrated in FIG. 2, the above-described engaging pieces 7*a*, 7*b* have beak-shape pointed end which angles upward slightly and whose lower side bends gradually. The width of the connection section between the engaging pieces 7*a*, 7*b* and the guide section 5*a*, 5*b* is slightly narrow.

A plurality of guide projections 111 are formed alternately at upper and lower edge sections on the inside of the guide sections 5*a*, 5*b* along their longitudinal direction and the guide projections 111 become the guide when inserting and removing the IC card 30.

Further, a rectangular shaped flat board section 15 that bridge-connects the guide sections 5*a*, 5*b* is formed close to above-described engaging grooves 9*a*, 9*b* while being integrated therewith. Supporting leg sections 17*a*, 17*b* are formed protrusively from lower ends of guide sections 5*a*, 5*b* at the connection points of the guide sections 5*a*, 5*b* and the flat board section 15 while being integrated with the guide sections 5*a*, 5*b*, and mounting holes 19*a*, 19*b* for tightening by use of screw and so forth are provided at these supporting leg sections 17*a*, 17*b*. Further, each part of the above-described engaging grooves 9*a*, 9*b* is formed in such a way as to be formed around the supporting leg sections 17*a*, 7*b* into long narrow groove near the mounting holes 19*a*, 19*b*. Rectangular shaped opening sections 6*a*, 6*b* that penetrate in the direction of board thickness are formed close to the supporting leg sections 17*a*, 17*b* of the guide sections 5*a*, 5*b*.

Further, at connection points of the above-described guide sections 5*a*, 5*b* and the engaging pieces 7*a*, 7*b*, a rectangular shaped upper board section 20 is disposed in such a way as to straddle between the above-described engaging pieces 7*a*, 7*b*.

A slightly protruded broad width section 20*a* is provided at the center of the edge section of the front side of the upper board section 20. Thin engaging claws 20*b*, 20*b* are formed in such a way as to project slightly near both sides of the broad width section 20*a*.

Figure 7:
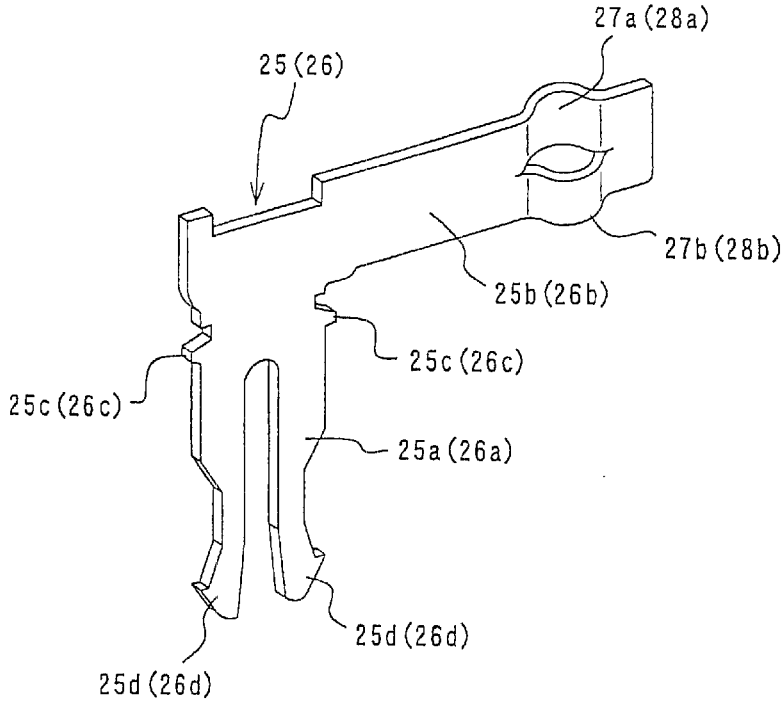
FIG. 7 is a schematic perspective view of a grounding terminal member of the IC card connector to be one embodiment of the present invention.

As illustrated in FIG. 7, grounding pieces 25, 26 to be grounding terminal members made of L-shaped sheet metal have leg sections 25*a*, 26*a* which are forked shape and flat board shaped arm sections 25*b*, 26*b* which are integrally formed with the leg sections 25*a*, 26*a* and are disposed at right angle to the leg sections 25*a*, 26*a*.

Pointed ends of the above-described leg sections 25*a*, 26*a* are engaging claws 25*d*, 25*d*, 26*d*, 26*d* capable of being deformed elastically and mount the leg sections 25*a*, 26*a* on the circuit substrate, which is described later, through the engaging claws 25*d*, 25*d*, 26*d*, 26*d* to ground.

First expanded sections 27*a*, 28*a* and second expanded sections 27*b*, 28*b* are formed in such a way as to be separated into an upper part and a lower part. The upper part and lower part are adjacent with each other while expanding outward of inside and outside surfaces of pointed end side of the above-described arm sections 25*b*, 26*b*.

Protruded sections 25*c*, 26*c* which are slightly protruded outward are formed at both side edges of the leg section 25*a*, 26*a* of the grounding pieces 25, 26, to serve as a removal prevention member at the time of mounting.

Further, detailed description of the aforementioned engaging claw 26*d* is that, as illustrated in enlarged view of FIG. 10, the shape of outside of pointed end of the engaging claw 26*d* has a tapered shape with the taper down, and where the upper side of the tapered portion has a perpendicular section and a horizontal section at a right angle to the perpendicular section. Furthermore, the engaging claw 26*d* has an inverse taper shaped portion from the horizontal section while connecting to the above-described protruded section 26*c*. Moreover, also the condition of the above-described engaging claw 25*d* is the same as that of the above-described engaging claw 26*d*.

Thus, when mounting the engaging claw 26*d* while inserting through the hole section of the circuit substrate which is described later, the engaging claw is mounted more firmly while absorbing the gap and depending on the perpendicular section and the horizontal sections of the leg sections 25*a*, 26*a* of the grounding pieces 25, 26.

Moreover, these grounding pieces 25, 26 are manufactured in such a way as to be formed from a blank metal plate by a press forming machine using one common multiple-die.

Figure 8:
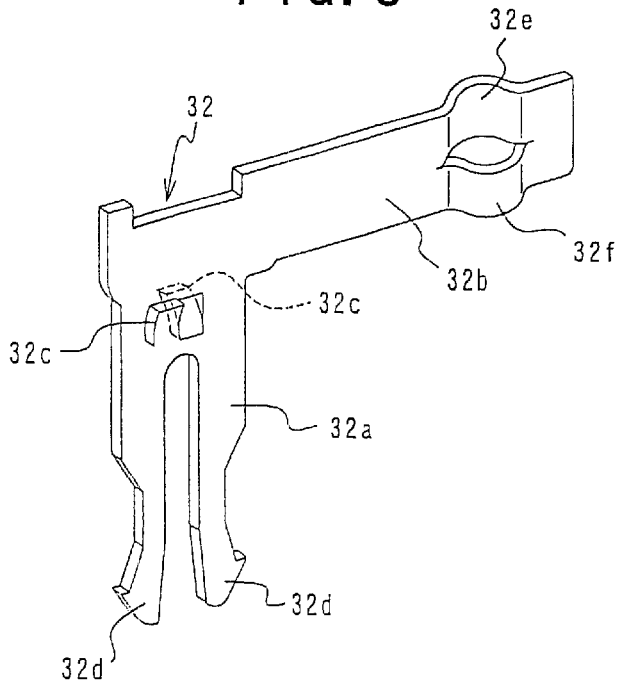
FIG. 8 is a view illustrating a modified example of the aforementioned grounding terminal member.

Further, FIG. 8 illustrates modified example of grounding pieces 25, 26.

This grounding piece 32 made of metal plate is provided integrally with a leg section 32*a*, a flat board shaped arm section 32*b* and first and second expanded sections 32*e*, 32*f* which expand outward of inside and outside of the arm section 32*b*. The leg section 32*a* is formed in forked shape, and pointed ends of the leg section 32*a* are engaging claws 32*d*, 32*d* capable of being deformed elastically. Further, rectangular shaped tongue pieces 32*c*, 32*c* that are cut to be raised outward from inside and outside surface of connection portion of the leg section 32*a* and the arm section 32*b* are formed adjacently right and left. Furthermore, the tongue pieces 32*c*, 32*c* are removal prevention members at the time of mounting.

Figure 13:
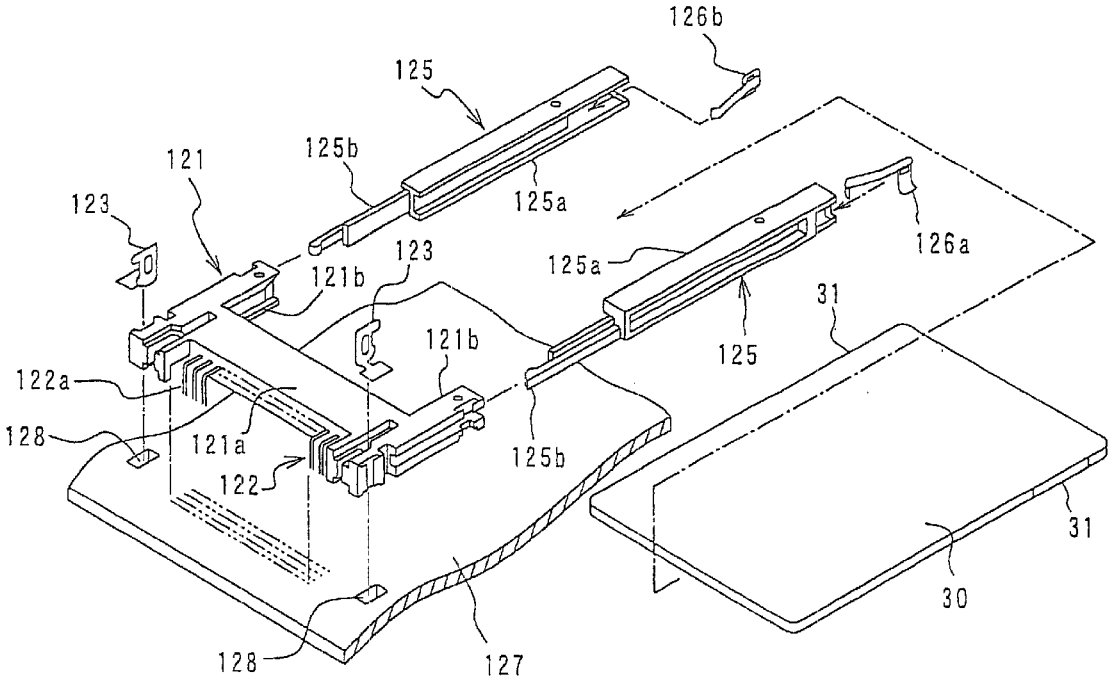
FIG. 13 PRIOR ART
FIG. 13 is an exploded perspective view of a conventional IC card connector, and perspective view of the IC card.
Figure 14:
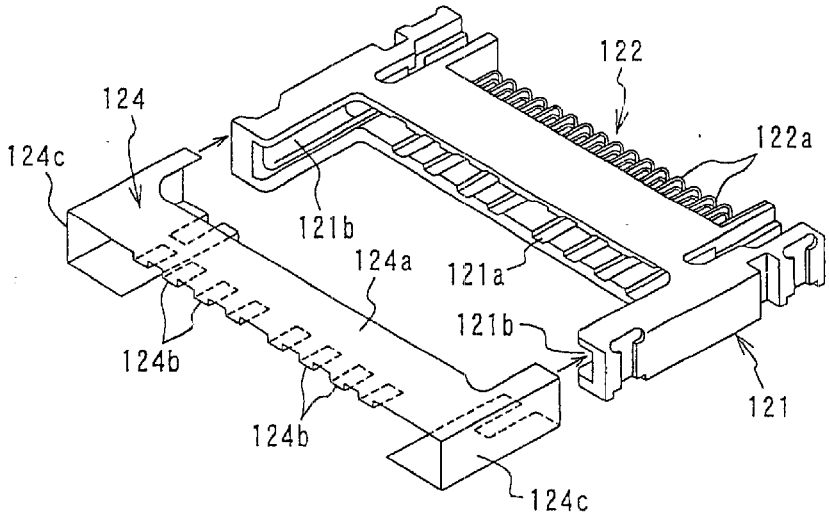
FIG. 14 PRIOR ART
FIG. 14 is a principal portion enlarged perspective view of the conventional IC card connector.

As illustrated in FIG. 10, the aforementioned grounding pieces 25, 26 are recessed to the inside of the engaging grooves 9*a*, 9*b* of the guide sections 5*a*, 5*b*, and the first and the second expanded sections 27*a*, 28*a*, 27*b*, 28*b* are made to be exposed from the opening sections 6*a*, 6*b* which are penetrated to be formed at the guide sections 5*a*, 5*b*, in which the first and the second expanded sections 28*a*, 27*b* from among them come into contact with a grounding terminal 31 (referring to FIG. 13) of the mounted IC card 30.

Figure 9:
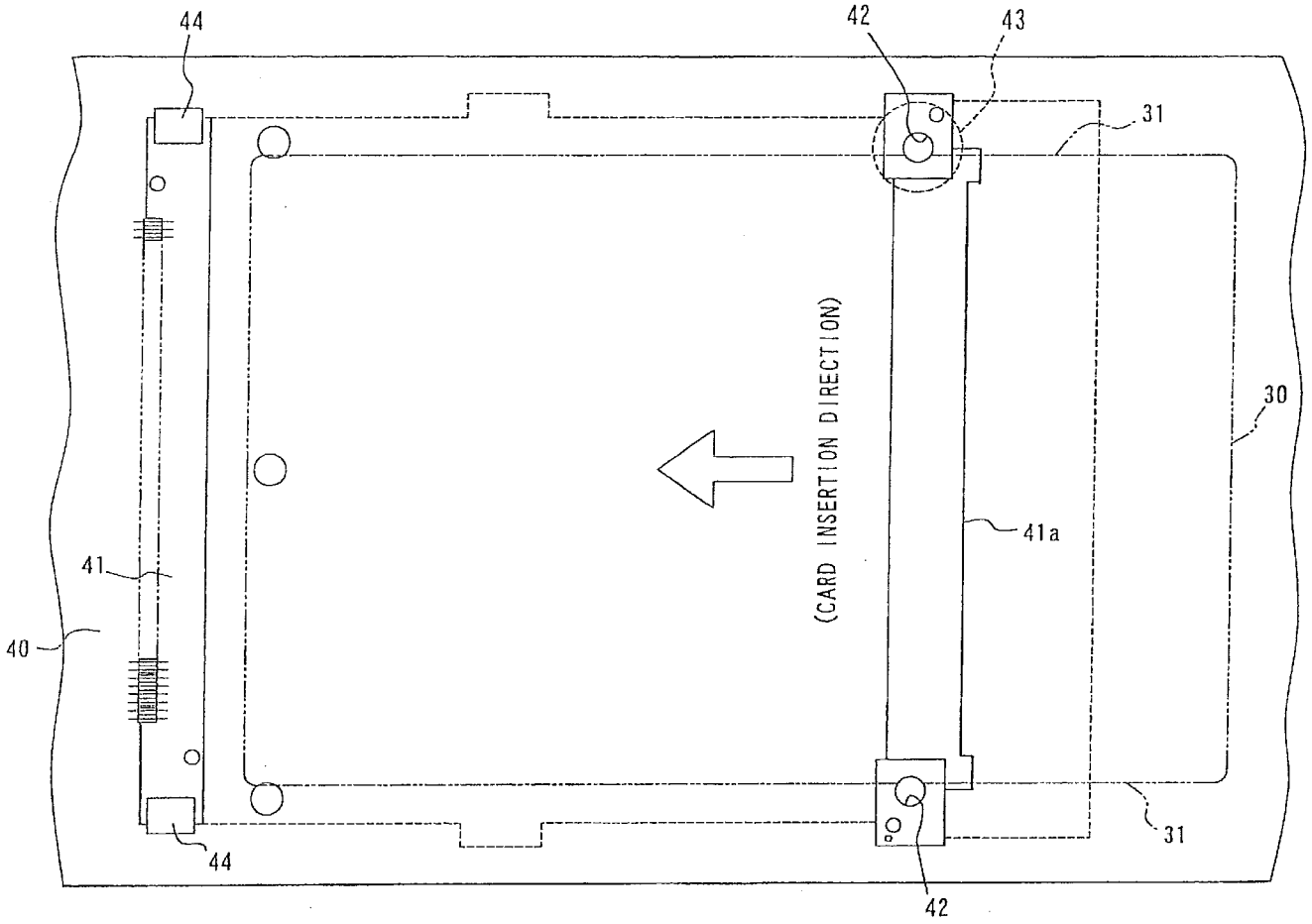
FIG. 9 is an explanation view for explaining relationship between the IC card connector and the circuit board.

As illustrated in FIG. 9, a circuit substrate 40 forms conductive patterns 41, 44 including grounded pattern 41, on which circuit substrate 40 electronic parts such as an IC, chip parts and so forth, not shown, are mounted by soldering and so forth.

The circuit substrate 40 forms thereon a pair of mounting holes (hole sections) 42, and forms a land section 43 made of metal foil around periphery of the mounting holes 42, and the land sections 43, which is electrically connected to the grounded pattern 41*a*.

Further, the circuit substrate 40 forms thereon a boss hole for positioning, in which part of the housing 1 and part of the frame 3 are inserted through this boss hole so that the circuit substrate is mounted to be fixed.

Next, description is made about fabrication of an IC card connector on the basis of FIG. 11A, FIG. 11B, and FIG. 11C below.

First, the insertion of a plurality of the pin terminals 2 is made into the base section 1*a* of the housing 1. Then one end of the pin terminals is formed to contact sections 2*b*, while the other end is formed into terminal sections 2*a* while bending the other end in the crank shape.

Figure 11A:
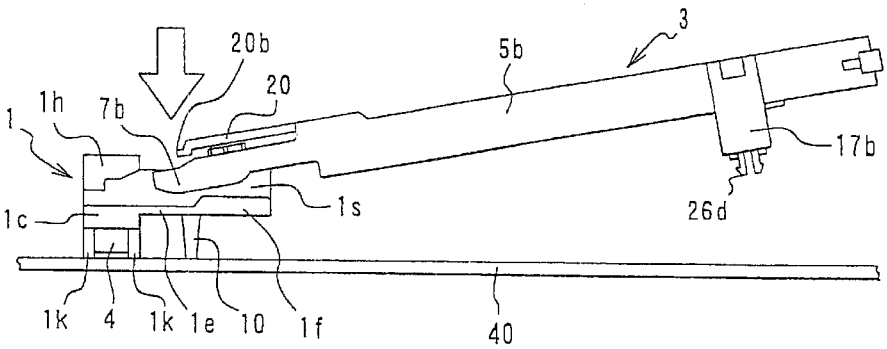
FIG. 11 is a operational explanation view for explaining mounting of the IC card connector to the substrate to be one embodiment of the present invention.

Next, as illustrated in FIG. 11A, the terminal sections 2*b* of the plural pin terminals 2 are soldered to a conductive pattern of the circuit substrate 40, while placing the housing I in predetermined position with respect to the circuit substrate 40. Moreover, as the need arises, the housing is tightened to be fixed to the circuit substrate 40 while inserting the screw and so forth into the mounting hole 1*d* of the housing 1. Further, a metallic terminal 4 is mounted on the engaging claw 1*k* of respective leg sections 1*c* of the housing 1. The metallic terminal 4 is mounted to be fixed to the conductive pattern 44 (referring to FIG. 9) of the circuit substrate 40 by the use of soldering. Thus, the housing 1 is mounted on the circuit substrate 40 with a predetermined height depending on the supporting leg sections 10, 12, and the leg section 1*c*.

Next, preparation is made to execute about a frame 3. Respective grounding pieces 25, 26 are made to insert through the engaging grooves 9*a*, 9*b* of the frame 3 from upper portion thereof to expose the first and the second expanded sections 27*a*, 28*a*, 27*b*, 28*b* formed on the arm sections 25*b*, 26*b* of the grounding pieces 25, 26 from the opening sections 6*a*, 6*b* formed on the guide sections 5*a*, 5*b*, and permitting the engaging claws 25*d*, 25*d*, 26*d*, 26*d* of the leg sections 25*a*, 26*a* to be projected through the engaging grooves 9*a*, 9*b* positioned within respective supporting leg sections 17*a*, 17*b* from lower end thereof.

Figure 11B:
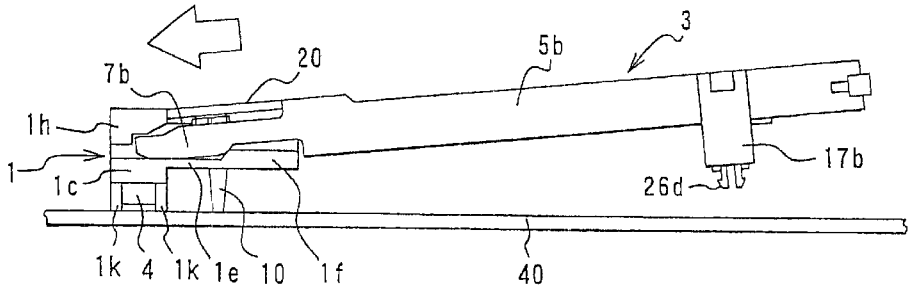

Next, as illustrated in FIG. 11B, the frame 3 is made to set in an obliquely inclined condition toward the housing 1 mounted on the circuit substrate 40, and the respective engaging pieces 7*a*, 7*b* are made to insert into the engaging groove Is of the arm section 1*b* of the housing 1 from the obliquely front direction (right side of FIG. 11B) while sliding along the engaging groove 1*s*.

Then, the engaging claws 20*b*, 20*b* of the upper board section 20 of the frame 3 are inserted through the rectangular grooves 22*b*, 22*b* (referring to FIG. 6) of the contact portions 22, 22 of the housing 1. Peripheral edge portions of the engaging claws 20*b*, 20*b* of the upper board section 20 strike the contact portions 22, 22. At the same time, pointed end portions of the engaging pieces 7*a*, 7*b* strike corner portions of respective right-angled struck section 1*h* of the housing 1.

Figure 11C:
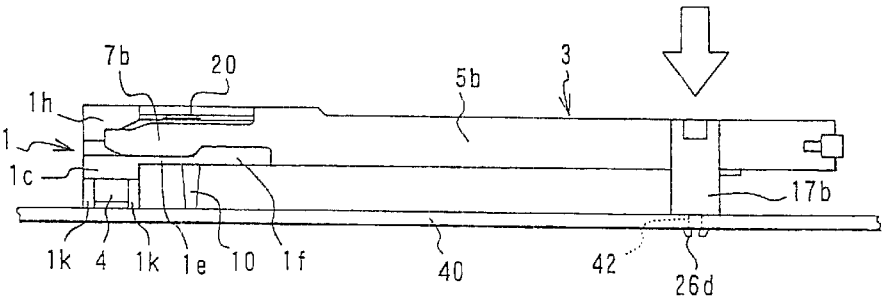

As illustrated in FIG. 11C, the frame 3 is made to push down so that the frame 3 becomes parallel with the circuit substrate 40, with the right-angled struck sections of the pointed ends of respective engaging pieces 7*a*, 7*b* as supports, and lower ends of the engaging pieces 7*a*, 7*b* are made to press against the first and the second long thin projection sections. As a result thereof, the broad width section 20*a* of the upper board section 20 of the frame 3 is disposed between the contact portions 22, 22 (referring to FIG. 1). Thus, the engaging claws 20*b*, 20*b* of the frame 3 are certainly recessed to the rectangular grooves 22*b*, 22*b* of the housing 1. Further, pointed ends of the beak shaped engaging pieces 7*a*, 7*b* are fitted to the respective right-angled struck sections 1*h* of the housing 1. The engaging claws 20*b*, 20*b* are recessed to the rectangular grooves 22*b*, 22*b*, therefore. movement of back and forth, right and left, and up and down of the frame 3 is restricted.

The supporting leg sections 17*a*, 17*b* of the frame 3 thus pushed down are placed on the circuit substrate 40. Moreover, the engaging pieces 7*a*, 7*b* are fitted to step sections 1*g* between the first and the second long thin projection sections 1*e*, 1*f*. Further, the engaging claws 25*d*, 26*d* of the grounding pieces 25, 26 are made to insert into the mounting hole 42 of the circuit substrate 40. The engaging claws 25*d*, 26*d* are subjected to snap-stopping while being deformed slightly and energizing elastically. After that, the engaging claws 25*d*, 26*d* are connected electrically to the land section 43 of the periphery edge of the mounting hole 42 while coming into contact therewith.

Thus, the IC card connector that is mounted on the circuit substrate 40 is completed.

Moreover, since both mounting holes (hole sections) 19*a*, 19*b* for mounting screws and the engaging grooves 9*a*, 9*b* for the grounding pieces 25, 26 are formed on the supporting leg sections 17*a*, 17*b*, it is possible that any one of the two is capable of being used. Namely, as described above, the grounding pieces 25, 26 are made to recess into the engaging grooves 9a, 9b of the guide sections 5*a*, 5*b*. The engaging claws 25*d*, 26*d* protruded from the supporting leg sections 17*a*, 17*b* are made to insert through the mounting hole 42 of the circuit substrate 40. However, as another method, these protruded engaging claws 25*d*, 26*d* are made to cut off or to bend. Nuts are made to set within the mounting holes 19*a*, 19*b* of the frame 3. Tightening screws toward the nuts from mounting hole 42 of the circuit substrate 40 allows the frame 3 and the circuit substrate 40 to be fastened. Thus, the grounding terminal 31 of the IC card 30 is made to ground to the grounded pattern 41*a* of the circuit substrate 40 through the rounding pieces 25, 26.

Further, also when incorporating the grounding piece 32 instead of one pair of the grounding pieces 25, 26 f or the IC card connector, the same effect as the grounding pieces 25, 26 is exhibited. The grounding pieces 32 are capable of being mounted more certainly within the engaging grooves 9*a*, 9*b* of the guide sections 5*a*, 5*b* depend in g on the tongue pieces 32*c*, 32*c*.

Figure 12:
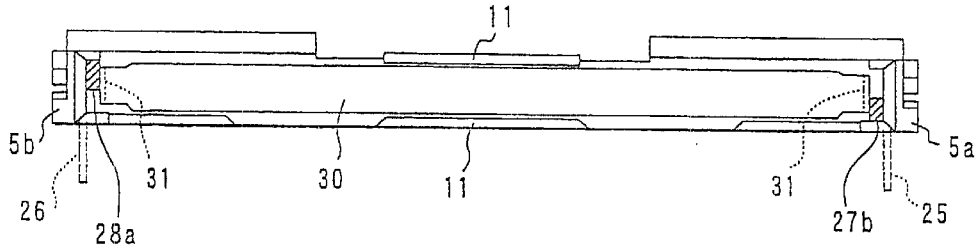
FIG. 12 is an explanation view for explaining condition where IC card of the IC card connector to be one embodiment of the present invention is mounted.

Next, operations of insertion and removal of the IC card 304 for the IC card connector will be described on the basis of FIG. 1, FIG. 9, and FIG. 12.

When inserting the IC card 30 illustrated in FIG. 9 into the guide sections 5*a*, 5*b* while being restricted by the guide projections 111 from un-inserted condition of the IC card 30 illustrated in FIG. 1, the grounding terminal 31 formed at side section of the IC card 30 is press to come into contact with both the first expanded section 28*a* and the second expanded section 27*b* of the grounding pieces 25, 26. Then, contact sections of the IC card are forced into the respective terminal sections 2*b* of the pin terminals 2 of the housing 1.

The IC card 30 is certainly mounted to the pin terminals 2 by inserting the IC card 30 by predetermined depth, resulting in completion.

At this time, the grounding terminal 31 of the IC card 30 is electrically connected to the grounded pattern 41*a* of the circuit substrate 40 through the grounding pieces 25, 26 to be grounded.

On the other hand, the IC card 30 is made to be removed from the IC card connector in such a way as to extrude the IC card 30 approximately straight in the removal direction from the connector either by pulling on both edge sections of the IC card 30 or by pressing on a push rod. which is not illustrated . when the IC card 30 is mounted within this IC card connector.

As described-above, the explanation has been made to execute one embodiment of the present invention, however, the present invention is not limited to the above-described embodiment, and various variations and modifications may be possible without departing from the scope of the present invention. For instance, a plurality of the first and the second expanded sections 27*a*, 27*b*, 28*a*, 28*b* of the grounding pieces 25, 26 can be provided, and it is good that the first and the second expanded sections 27*a*, 27*b*, 28*a*, 28*b* of the g rounding pieces 25, 26 are formed in the tongue piece shape. Further, it is also good that they are pressed by only a punch press, thus it is possible to simplify processing work.

As explained above, the grounding terminal member of the invention is provided integrally with the leg section, flat plate shaped arm section, the first and the second expanded sections that are expanded outward at inside and outside surfaces of the arm section in such a way as to blank a metal plate, in which the leg section is made to ground and any one of the first and the second expanded sections is made to execute elastic contact to a grounding terminal of the electronic parts, thereby, it is possible to form respective grounding terminal members by use of only one die. Accordingly, two different parts may be made as the same part, thus drastically reducing cost.

Further, the IC card connector is provided with a housing on which a plurality of pin terminals are mounted, and a frame which is mounted on the housing. A pair of guide sections for guiding insertion and removal of the IC card are provided at both side sections of the frame in the longitudinal direction thereof. respective arm sections of the grounding terminal members are mounted on the respective guide sections, in which the IC card is made to insert into respective guide sections there between. A grounding terminal of one side section of the IC card is made to come into contact with the first expanded section, while a grounding terminal of the other side section of the IC card is made to come into contact with the second expanded section. It is good that only common grounding terminal members are mounted on respective guide sections. Since there is no distinction between right side grounding terminal member and left side grounding terminal member, there is no fear of error fabrication. Thus it is possible to improve efficiency of work.

Furthermore. the housing is made to mount on the circuit substrate, followed by allowing pointed ends of the leg section of the grounding terminal member to be projected, so that continuity is established between the pointed ends and the grounded pattern of the circuit substrate. The grounding terminal of the IC card is capable of being grounded to the grounded pattern of the circuit substrate through the leg section of the grounding terminal member.

Moreover, the supporting leg sections are provided protrusively at both side sections of the frame. Pointed ends of the supporting leg sections are placed on the surface of the circuit substrate, further allowing the pointed ends of leg sections of the grounding terminal members to be projected from the supporting leg sections. The grounding terminal member makes the grounding of the IC card possible when the frame is set apart from the circuit substrate by constant distances. The frame is capable of being mounted on the circuit substrate through the supporting leg sections.

Still moreover, the engaging claws are formed at pointed ends of the leg sections. The guide sections are made to engage to the circuit substrate while inserting the engaging claws into the hole sections of the circuit substrate. Therefore, it is unnecessary to attach by use of the screws, so that it is possible to mount the guide section on the circuit substrate by performing the snap-stopping depending on only elastic deformation of the engaging claws.

What is claimed is:

1. An IC card connector comprising:

a housing having a plurality of terminal members, arranged side by side and having an IC card connected thereto, and a pair of guide sections oppositely faced to each other with a space into which said IC card is inserted being held therebetween, and for use in guiding said IC card to a position where it is connected with said housing, wherein each of said guide sections is provided with a grounding terminal contacting each of earth terminals arranged at both sides opposing against a direction crossing at a right angle with an inserting direction in said IC card, each of said grounding terminals is of the same shape and provided with a leg section extending in a height direction of each of said guide sections and contacted with an earth pattern of a circuit substrate, and an arm section extending from said leg section toward a longitudinal direction of each of said guide sections, said arm section is formed with a first expanded section and a second expanded section at its upper and lower parts, each of said first expanded section and said second expanded section protrudes to opposite front and rear sides, said first expanded section at one of said grounding terminals is contacted with one of said earth terminals and said second expanded section at the other grounding terminal is contacted with the other earth terminal.

2. An IC card connector according to claim 1, wherein said housing is made to mount on a circuit substrate, subsequently, allowing a pointed end of said leg section of said grounding terminal member to be projected from said guide section to establish continuity between said pointed end and a grounded pattern of said circuit substrate.

3. An IC card connector according to claim 2, wherein each of said guide sections is formed while both side sections of the frame which can be mounted at said housing are extended, supporting leg sections are provided at both side sections of said frame, and a pointed end of each of said leg sections of each of said grounding terminal members is projected from each of said supporting leg sections in a state in which the pointed ends of said supporting leg sections are placed on the surface of said circuit substrate.

4. An IC card connector according to claim 2, wherein pointed ends of said leg sections are notched to form a pair of engaging claws, and each of said engaging claws is inserted into hole sections of said circuit substrate to engage each of said guide sections to said circuit substrate.

* * * * *